US008480863B2

(12) United States Patent
Gullá et al.

(10) Patent No.: US 8,480,863 B2
(45) Date of Patent: Jul. 9, 2013

(54) CATHODE FOR ELECTROLYTIC PROCESSES

(75) Inventors: Andrea Francesco Gullá, Shaker Heights, OH (US); Sobha Abraham, Mentor on the Lake, OH (US)

(73) Assignee: Industrie de Nora S.p.A., Milan (IT)

( * ) Notice: Subject to any disclaimer, the term of this patent is extended or adjusted under 35 U.S.C. 154(b) by 0 days.

(21) Appl. No.: 13/359,122

(22) Filed: Jan. 26, 2012

(65) Prior Publication Data

US 2012/0125785 A1 May 24, 2012

Related U.S. Application Data

(63) Continuation of application No. PCT/EP2010/060838, filed on Jul. 27, 2010.

(60) Provisional application No. 61/229,057, filed on Jul. 28, 2009.

(51) Int. Cl.
*C25B 11/10* (2006.01)
*B05D 3/02* (2006.01)

(52) U.S. Cl.
USPC ..... 204/290.12; 204/290.14; 204/290.03; 204/290.06; 204/290.01; 427/126.3; 427/126.2; 427/226; 427/229; 427/331; 427/376.3; 427/376.4; 427/376.6; 427/379; 427/380; 427/419.3

(58) Field of Classification Search
USPC ..... 204/290.12, 290.14, 290.03, 290.06, 204/290.01; 427/126.3, 126.2, 226, 229, 427/331, 376.3, 376.4, 376.6, 379, 380, 419.3
See application file for complete search history.

(56) References Cited

U.S. PATENT DOCUMENTS

| | | | | |
|---|---|---|---|---|
| 3,948,751 | A * | 4/1976 | Bianchi et al. | 204/290.03 |
| 6,310,040 | B1 | 10/2001 | Bozyczko-Coyne et al. | |
| 6,527,939 | B1 * | 3/2003 | Hardee | 205/292 |
| 7,201,830 | B2 * | 4/2007 | Mojana et al. | 204/290.01 |
| 7,514,398 | B2 | 4/2009 | Upton et al. | |
| 7,815,781 | B2 * | 10/2010 | Mojana et al. | 204/290.12 |
| 2005/0211553 | A1 * | 9/2005 | Mojana et al. | 204/290.01 |
| 2006/0166328 | A1 | 7/2006 | Glass et al. | |
| 2007/0261968 | A1 * | 11/2007 | Carlson et al. | 205/354 |

FOREIGN PATENT DOCUMENTS

| | | | |
|---|---|---|---|
| EP | 0215649 | A1 | 3/1987 |
| EP | 0545869 | A1 | 11/1993 |
| EP | 1477585 | A2 | 11/2004 |
| JP | 2007154237 | A | 6/2007 |

OTHER PUBLICATIONS

International Search Report for Application No. PCT/EP2010/060838 dated Sep. 16, 2010. 4 pages.
Restriction Requirement issued in U.S. Appl. No. 12/991,104 dated Jul. 25, 2012.
Office Action issued in U.S. Appl. No. 12/991,104 dated Oct. 12, 2012.

* cited by examiner

*Primary Examiner* — Bruce Bell
(74) *Attorney, Agent, or Firm* — Eschweller & Associates, LLC

(57) ABSTRACT

The invention relates to an electrode for electrolytic applications, optionally an oxygen-evolving anode, obtained on a titanium substrate and having a highly compact dual barrier layer comprising titanium and tantalum oxides and a catalytic layer. A method for forming the dual barrier layer comprises the thermal decomposition of a precursor solution applied to the substrate optionally followed by a quenching step and a lengthy thermal treatment at elevated temperature.

12 Claims, 3 Drawing Sheets

CATHODE FOR ELECTROLYTIC PROCESSES

CROSS-REFERENCE TO RELATED APPLICATION

This application is a continuation of PCT/EP2010/060838 filed Jul. 27, 2010, that claims the benefit of the priority date of U.S. Provisional Patent Application No. 61/229,057 filed Jul. 28, 2009, the contents of which are herein incorporated by reference in their entirety.

FIELD

The invention relates to an electrode for electrolytic applications, in particular to an electrode suitable for use as oxygen-evolving anode in aqueous electrolytes.

BACKGROUND

The electrode of the invention can be employed in a wide range of electrolytic processes with no limitation, but is particularly suited to operate as an oxygen-evolving anode in electrolytic process.

Oxygen-evolving processes are well known in the field of industrial electrochemistry and include a large variety of electrometallurgical processes—such as electrowinning, electrorefining, electroplating—besides cathodic protection of cementitious structures and other non-metallurgical processes.

Oxygen is usually evolved on the surface of a catalyst-coated valve metal anode; valve metal anodes provide suitable substrates in view of their acceptable chemical resistance in most electrolytic environments, which is imparted by a very thin oxide film formed on their surface that retains a good electrical conductivity. Titanium and titanium alloys are the most common choice for the valve-metal substrate in view of their mechanical characteristics and their cost. The catalyst coating is provided in order to decrease the overpotential of the oxygen evolution reaction and usually contains platinum group metals or oxides thereof, for instance iridium oxide, optionally mixed with film-forming metal oxides such as titanium, tantalum or tin oxide.

Anodes of this kind have acceptable performances and lifetime in some industrial applications, but they are often insufficient to withstand the aggressiveness of some electrolytes especially in processes carried out at high current density, such as the case of most electroplating processes.

The failure mechanism of oxygen-evolving anodes, particularly at current density higher than 1 kA/m$^2$, often involves a localised attack at the coating-to-substrate interface, leading to the formation of a thick insulating valve-metal oxide layer (substrate passivation) and/or to the cleavage and detachment of the catalyst coating therefrom. A way to prevent or substantially slow down such phenomena is to provide a protective barrier layer between the substrate and the catalyst coating. A suitable barrier layer should hinder the access of water and acidity to the substrate metal while retaining the required electrical conductivity. Titanium metal substrates can for instance be protected by interposing a metal oxide-based barrier layer, e.g. a barrier layer of titanium oxide and/or tantalum oxide, between the substrate and the catalyst coating. Such layer needs to be very thin (e.g. a few micrometres), otherwise the very limited electrical conductivity of titanium and tantalum oxides would make the electrode unsuitable for working in an electrochemical cell, or in any case would cause the cell voltage to increase too much with consequent increase of the electrical energy consumption needed to carry out the required electrolytic process. On the other hand, extremely thin barrier layers are liable to present fissures or other defects that can be penetrated by process electrolytes, eventually leading to harmful localised attacks.

Metal oxide-based barrier layers can be obtained in a number of different ways. For example, an aqueous solution of metal precursor salts, e.g. chlorides or nitrates, can be applied to the substrate, for instance by brushing or dipping and thermally decomposed to form the corresponding oxides: this method can be used to form mixed oxide layers of metals such as titanium, tantalum or tin, but the obtained barrier layer is generally not compact enough and presents cracks and fissures making it unsuitable for the most demanding applications. Another way to deposit a protective oxide film is by means of various deposition techniques such as plasma or flame spraying, arc-ion plating or chemical/physical vapour deposition, which are cumbersome and expensive processes that can be intrinsically difficult to scale-up as one of skill in the art readily appreciates; furthermore, these methods are characterised by a critical balance between electrical conductivity and efficacy of the barrier effect which in many cases does not lead to a fully satisfactory solution.

The simple use of a barrier layer as a protective means against corrosive attacks has always the disadvantage that inevitable local defects in the barrier structure are easily turned into sites for a preferential chemical or electrochemical attack to the underlying substrate; a destructive attack on a localised portion of the substrate can spread in many cases at the barrier-to-substrate interface and result in the electrical insulation of the substrate by virtue of a massive oxide growth and/or to an extensive cleavage of the coated components from the substrate.

The above considerations show how it is highly desirable to identify a more efficient protective barrier layer for electrodes that can be operated as oxygen-evolving anodes in electrolytic processes.

BRIEF DESCRIPTION OF THE DRAWING FIGURES

DESCRIPTION

Figure 1:
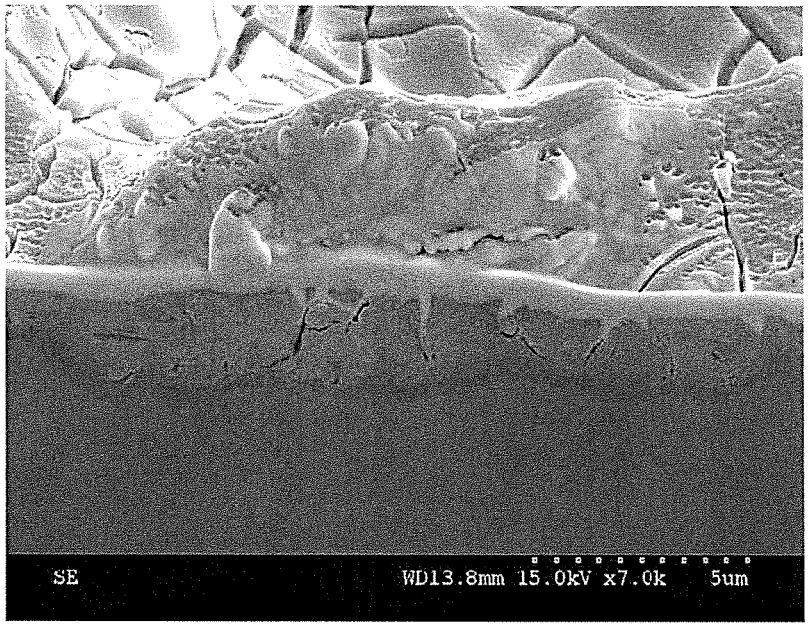
FIG. 1 illustrates a Scanning Electron Microscope (SEM) image of a cross-section of an electrode according to an embodiment of the invention.

Several aspects of the present invention are set forth in the appended claims. Under one aspect, an electrode for electrolytic applications comprises a substrate made of titanium or titanium alloy and a catalytic layer based on platinum group metals or oxides thereof with a dual barrier layer in-between, the dual barrier layer being comprised of:

- a primary, more external barrier layer in direct contact with the catalytic layer and consisting of a thermally-densified mixed phase of titanium-tantalum oxide, and
- a secondary, more internal barrier layer in direct contact with the substrate and essentially consisting of non-stoichiometric titanium oxide modified with tantalum oxide and titanium oxide inclusions diffusing from the primary barrier layer.

The primary barrier layer is characterised by being extremely compact, for instance twice as compact as an oxide barrier of the prior art; in one embodiment, the density of the primary barrier layer, expressed as degree of compactness of its constituent particles, is in excess of 25 particles per 10,000 $nm^2$ surface as detected by an X-ray spectroscopy technique. In another embodiment, the density of the primary barrier layer, expressed as degree of compactness of its constituent particles, is in excess of 80 particles per 10,000 $nm^2$ surface, for instance comprised between 80 and 120 particles per 10,000 $nm^2$ surface. This range approaches or corresponds to the maximum degree of compactness obtainable with a titanium-tantalum oxide mixed phase and therefore can have the advantage of providing a virtually defect-free barrier imparting an excellent protection even at a very reduced thickness. Providing an effective primary barrier layer having a very limited thickness allows improving the electrical conductivity of the whole electrode.

The secondary barrier layer is characterised by being highly conductive, its bulk essentially consisting of non-stoichiometric titanium oxide grown from the underlying metal surface, which is inherently more conductive than stoichiometric $TiO_2$; $Ta^{+5}$ inclusions further enhance the conductivity of this layer. This enhanced conductivity leads to a decrease in the rate of transport of Ti ions across the oxide layer and consequently to a decrease in the growth rate of the passivation layer. On the other hand, tantalum oxide and titanium oxide inclusions can form solid-state solutions, which can have the advantage of shifting the potential of formation of titanium oxide to more anodic values.

In one embodiment, the Ti:Ta molar ratio in the mixed titanium-tantalum oxide phase of the primary barrier layer is 60:40 to 80:20. This composition range is particularly useful for providing a high performance barrier layer of oxygen-evolving anodes. In other embodiments, different gas-evolving electrodes, e.g. chlorine-evolving electrodes, may comprise mixed titanium-tantalum oxide barrier layers of different molar composition.

In one embodiment, the primary barrier layer is modified with a doping agent selected from the group consisting of the oxides of Ce, Nb, W and Sr. It was surprisingly observed that an amount of 2 to 10 mol % of such species in a barrier layer based on a mixed titanium-tantalum oxide composition with a Ti:Ta molar ratio of 60:40 to 80:20 can have a beneficial effect on the overall duration of the electrode. In these conditions, the secondary barrier layer also contains inclusions of the corresponding oxide.

A primary barrier layer of the above indicated density allows an oxygen-evolving anode to withstand the most aggressive industrial operative conditions even with a thickness of a few micrometres. In one embodiment, the primary barrier layer has a thickness of at least 3 micrometres; this can have the advantage of minimising the presence of possible through-defects. The thickness of the primary barrier layer can be made higher if the goal is to increase the electrode lifetime as much as possible. In one embodiment, the primary barrier layer has a thickness not exceeding 25 micrometres, to avoid incurring excessive resistive penalties. The thickness of the secondary barrier layer, resulting from the modification of a titanium oxide layer with tantalum oxide and titanium oxide inclusions during the thermal-densification step of the primary barrier layer, is normally about 3 to about 6 times lower than that of the primary barrier layer. In one embodiment, the secondary barrier layer has a thickness of 0.5 to 5 micrometres.

The above described electrode can be used in a wide range of electrochemical applications, but it is particularly useful as oxygen-evolving anode in electrolytic applications, especially at high current density (e.g. metal electroplating and the like). In this case, it can be advantageous to provide a mixed metal oxide-based catalytic layer on top of the dual barrier layer. In one embodiment, the catalytic layer comprises iridium oxide and tantalum oxide, which can have the advantage of reducing the overpotential of the oxygen evolution reaction especially in acidic electrolytes.

In one embodiment, the electrode is produced by applying a precursor solution containing suitable titanium and tantalum species to a titanium substrate, drying at 120-150° C. until removing the solvent and thermally decomposing the precursors at 400-600° C. until forming a titanium and tantalum mixed oxide layer, which is normally obtained in 3 to 20 minutes; this step can be repeated for several times until obtaining a titanium and tantalum mixed oxide layer of the required thickness. In a subsequent step, the substrate coated with the titanium and tantalum mixed oxide layer is post-baked at 400-600° C. until forming a dual barrier layer as above described. The post-baking thermal treatment has the advantage of densifying the titanium and tantalum mixed oxide layer to an extreme extent, meanwhile facilitating the migration of titanium oxide and tantalum oxide species to the underlying titanium substrate, thereby forming a secondary barrier layer of enhanced conductivity which can also have an oxidation potential (corresponding to the potential of formation of titanium oxide) shifted to positive values. In a final step, a catalytic layer is formed on said dual barrier layer by applying and thermally decomposing a solution containing platinum group metal compounds in one or more coats.

In one embodiment, the titanium and tantalum precursor solution is a hydroalcoholic solution having a molar content of water of 1 to 10% and containing a Ti alkoxide species, for example Ti isopropoxide. This solution can be obtained for example by mixing a commercial Ti-isopropoxide solution with a $TaCl_5$ solution and adjusting the water content by addition of aqueous HCl. Having such a reduced water content in the precursor solution can assist in the densifying process of the titanium-tantalum mixed oxide phase of the primary barrier layer. In another embodiment, the precursor solution contains the Ti ethoxide or butoxide species. In one embodiment, the titanium and tantalum precursor solution further contains a salt, optionally a chloride, of Ce, Nb, W or Sr.

In one embodiment, after the step of thermal decomposition of the titanium and tantalum precursor solution, the obtained titanium and tantalum mixed oxide layer is pre-densified by quenching the electrode in a suitable medium. In one embodiment, the cooling rate of the quenching step is at least 200° C./s; this can be obtained for example by extracting the substrate coated with the titanium and tantalum mixed oxide layer from the oven (at 400-600° C.) and dipping the same straight away in cold water. Post-baking at 400 to 600° C. for a sufficient time is subsequently carried out in order to form the dual barrier layer. The quenching step can be also effected in other suitable liquid media such as oil, or also in air, optionally under forced ventilation. Quenching can have the advantage of assisting the densification of the mixed titanium-tantalum oxide phase and allowing to reduce the duration of the subsequent post-baking step to a certain extent.

The following examples are included to demonstrate particular embodiments of the invention. It should be appreciated by those of skill in the art that the compositions and techniques disclosed in the examples which follow represent compositions and techniques discovered by the inventors to function well in the practice of the invention, and thus can be considered to constitute preferred modes for its practice.

However, those of skill in the art should, in light of the present disclosure, appreciate that many changes can be made in the specific embodiments which are disclosed and still obtain a like or similar result without departing from the scope of the invention.

EXAMPLE 1

A titanium grade 1, 0.89 mm thick sheet was etched in 18% vol. HCl and degreased with acetone. The sheet was cut to 5.5 cm×15.25 cm pieces. Each piece was used as an electrode substrate and coated with a precursor solution obtained by mixing a Ti-isopropoxide solution (175 g/l in 2-propanol) and a $TaCl_5$ solution (56 g/l in concentrated HCl) in different molar ratios (composition 1: 100% Ti; composition 2: 80% Ti, 20% Ta; composition 3: 70% Ti, 30% Ta; composition 4: 60% Ti, 40% Ta; composition 5: 40% Ti, 60% Ta; composition 6: 20% Ti, 80% Ta; composition 7: 100% Ta). Three different samples were prepared for each of the above listed compositions, in the following way: the seven precursor solutions were applied to the corresponding substrate samples by brushing, then the substrates were dried at 130° C. for about 5 minutes and subsequently cured at 515° C. for 5 minutes. This operation was repeated 5 times, then each coated substrate was subjected to a final thermal treatment at 515° C. for 3 hours.

Two samples for each composition were finally coated with a catalytic layer consisting of a mixture of iridium and tantalum oxides, with a total iridium loading of 7 g/m$^2$, by thermal decomposition of an alcoholic solution of iridium and tantalum chlorides in multiple coats.

At the end of this step, half of the coated samples were characterised by Scanning Electron Microscopy (SEM), all of them revealing the characteristic features of the cross-section shown in FIG. 1, referring to a dual barrier layer obtained from composition 3, 1 being the titanium metal substrate, 3 (light grey area) being the primary barrier layer consisting of a thermally-densified mixed titanium-tantalum oxide ($Ti_xO_y/Ta_xO_y$) layer, 2 being (dark grey area) the secondary barrier layer consisting of a non-stoichiometric titanium oxide grown from substrate 1 and modified by Ti oxide and Ta oxide inclusions coming from the primary barrier layer 3, 4 being the catalytic layer consisting of a mixture of Ir and Ta oxides.

Figure 2:
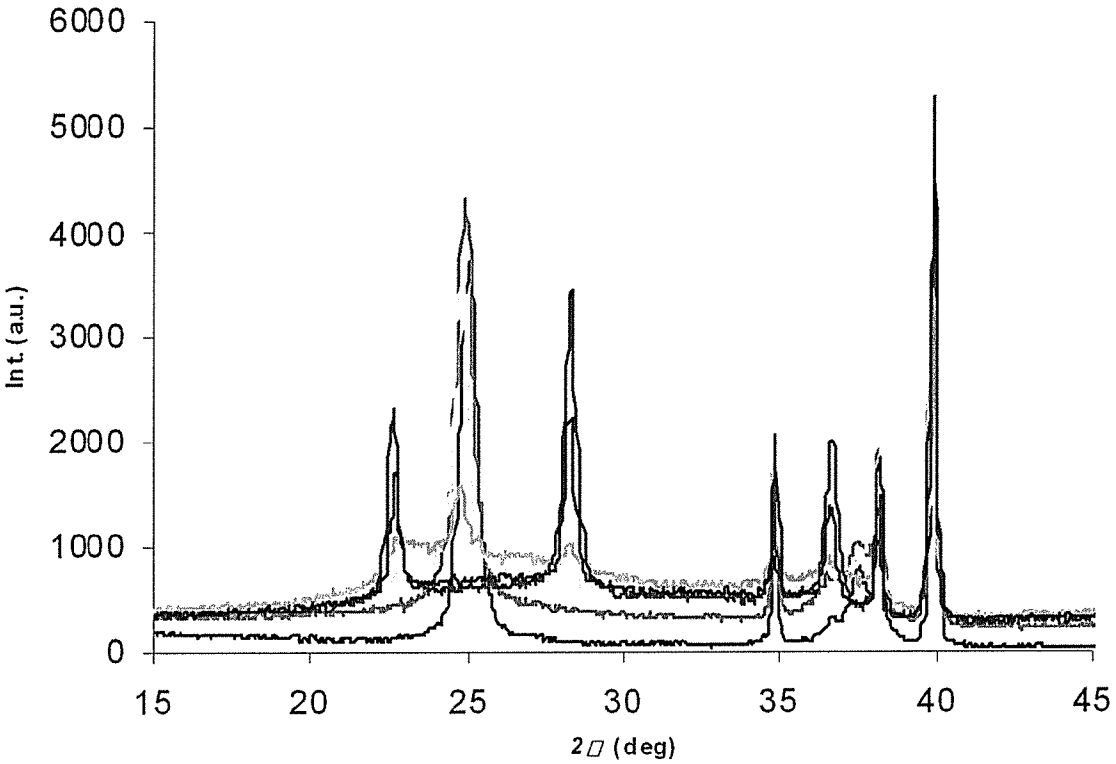
FIG. 2 illustrates a collection of XRD spectra of samples of primary barrier layers according to an embodiment of the invention.

The series of samples that was not coated with the catalyst layer was subjected to X-Ray Diffraction (XRD), obtaining the spectra collected in FIG. 2, wherein peak 10 can be attributed to the titanium substrate, peaks 20 and 21 are characteristics of titanium oxide species and peaks 30, 31 and 32 can be attributed to tantalum.

By integration of the characteristic XRD peaks it is possible to obtain the $Ti_xO_y/Ta_xO_y$ average particle diameter for each composition, as well as the corresponding volume and surface, under the assumption that particles are mostly spherical. Such parameters are a measure of the average space occupied by oxide particles packed in the crystal lattice. The particle surface density for each composition can be expressed as the number of particles packed in a 10,000 nm$^2$ area and is an index of the compactness of the obtained barrier layer. The data reported in Table 1 show that in a certain range of composition (from about 80% Ti, 20% Ta to about 60% Ti, 40% Ta) the particle surface density is very close to the theoretical limit.

TABLE 1

| Composition ID | $Ti_xO_y/Ta_xO_y$ average particle diameter (nm) | $Ti_xO_y/Ta_xO_y$ particle volume (nm$^3$) | $Ti_xO_y/Ta_xO_y$ particle surface (nm$^2$) | $Ti_xO_y/Ta_xO_y$ particle surface density (particles/ 10,000 nm$^2$) |
|---|---|---|---|---|
| 1 | 12.72 | 1078 | 508 | 78.68 |
| 2 | 11.15 | 726 | 391 | 102.36 |
| 3 | 10.78 | 656 | 365 | 109.59 |
| 4 | 11.00 | 697 | 380 | 105.18 |
| 5 | 21.23 | 5014 | 1417 | 28.23 |
| 6 | 21.58 | 5265 | 1464 | 27.33 |
| 7 | 20.50 | 4511 | 1320 | 30.29 |

The same XRD characterisation was repeated on one series of coated samples and analogous results were obtained, although the presence of tantalum peaks coming from the catalyst make calculations more difficult.

An accelerated duration test was carried out on the other series of coated samples under oxygen evolution in 150 g/l $H_2SO_4$ at 65° C., at a current density 20 kA/m$^2$ and using a zirconium cathode as counterelectrode with a 1.27 cm electrode gap. The test measures the electrode lifetime under oxygen evolution in the specified conditions, defined as the time needed to increase the initial cell voltage by 1 V. All samples under test showed a lifetime above 1400 hours. Samples having a barrier layer corresponding to compositions 2, 3 and 4 showed a lifetime of 1800 to 2000 hours, corresponding to more than 250 hours per g/m$^2$ of noble metal.

EXAMPLE 2

A titanium grade 1, 0.89 mm thick expanded sheet was etched in 18% vol. HCl and degreased with acetone. The sheet was cut to 5.5 cm×15.25 cm pieces. Each piece was used as an electrode substrate and coated with a precursor solution obtained by mixing a Ti-isopropoxide solution (175 g/l in 2-propanol) and a $TaCl_5$ solution (56 g/l in concentrated HCl) in different molar ratios corresponding to compositions 1 and 3 of the previous example. Three different samples were prepared for each composition, in the following way: the two precursor solutions were applied to the corresponding substrate samples by brushing, then the substrates were dried at 130° C. for about 5 minutes and subsequently cured at 515° C. for 5 minutes. After the curing, the samples were quenched by dipping in de-ionised water at 20° C. In this way, a quenching rate of about 250° C./s was obtained. The whole operation was repeated 5 times, then each coated substrate was subjected to a final thermal treatment at 515° C. for 3 hours.

Two samples for each composition were finally coated with a catalytic layer consisting of a mixture of iridium and tantalum oxides, with a total iridium loading of 7 g/m$^2$, by thermal decomposition of an alcoholic solution of iridium and tantalum chlorides in multiple coats.

The SEM and XRD characterisations of Example 1 were repeated with analogous results. In particular, the data extracted from the XRD spectra are reported in Table 2.

TABLE 2

| Composition ID | $Ti_xO_y/Ta_xO_y$ average particle diameter (nm) | $Ti_xO_y/Ta_xO_y$ particle volume (nm$^3$) | $Ti_xO_y/Ta_xO_y$ particle surface (nm$^2$) | $Ti_xO_y/Ta_xO_y$ particle surface density (particles/ 10,000 nm$^2$) |
|---|---|---|---|---|
| 1 | 11.44 | 784 | 411 | 97.32 |
| 3 | 10.66 | 634 | 357 | 112.0 |

An accelerated duration test was carried out on the coated samples that were not used for SEM and XRD characterisations, as in Example 1. Both samples showed a lifetime of about 2000 hours.

Counterexample

A titanium grade 1, 0.89 mm thick expanded sheet was etched in 18% vol. HCl and degreased with acetone. The sheet was cut to 5.5 cm×15.25 cm pieces. Each piece was used as an electrode substrate and coated with a precursor solution obtained by mixing a $TiCl_3$ aqueous solution and a $TaCl_5$ hydrochloric solution, in different molar ratios corresponding to the seven compositions of Example 1. Three different samples were prepared for each composition, in the following way: the seven precursor solutions were applied to the corresponding substrate samples by brushing, then the substrates were dried at 130° C. for about 5 minutes and subsequently cured at 515° C. for 5 minutes. This operation was repeated 5 times. No final thermal treatment and no quenching step were applied.

Two samples for each composition were finally coated with a catalytic layer consisting of a mixture of iridium and tantalum oxides, with a total iridium loading of 7 g/m$^2$, by thermal decomposition of an alcoholic solution of iridium and tantalum chlorides in multiple coats as in the previous examples.

Figure 3:
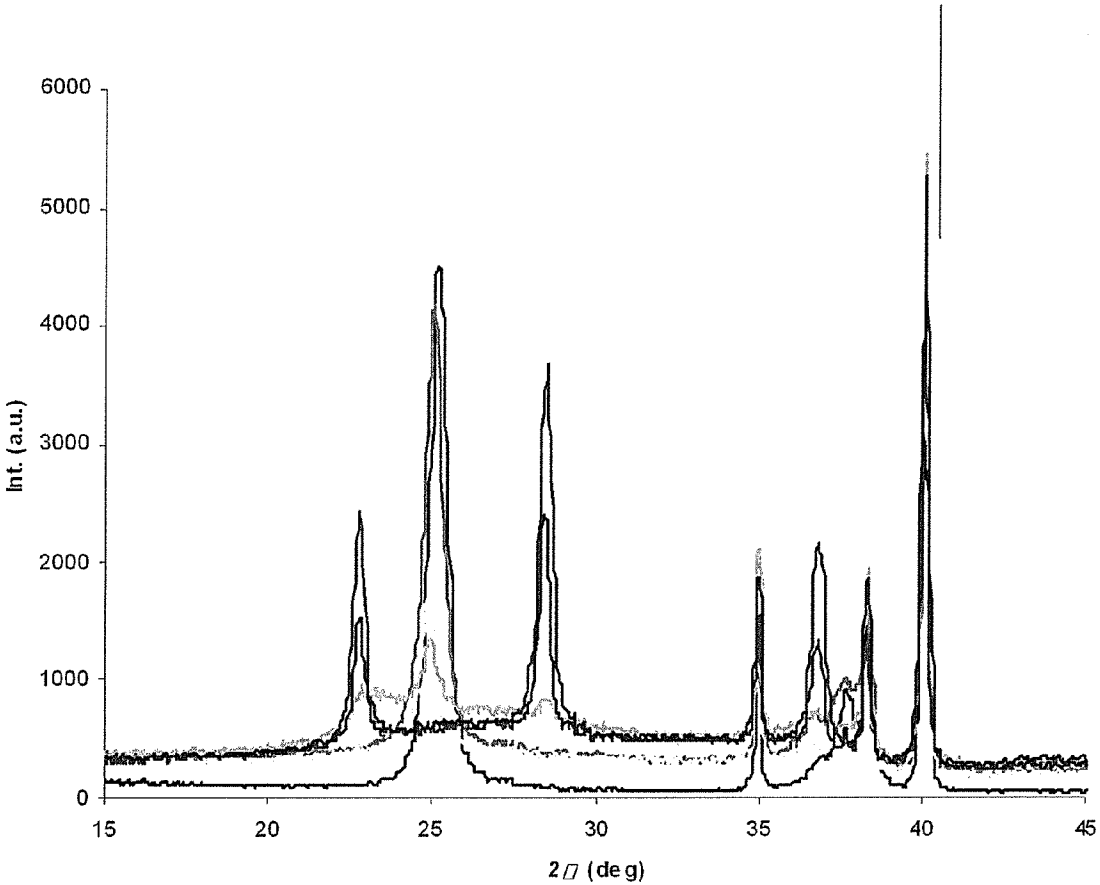
FIG. 3 illustrates a collection of XRD spectra of samples of primary barrier layers according to the prior art.

At the end of this step, half of the coated samples were characterised by Scanning Electron Microscopy (SEM), all of them showing a single $Ti_xO_y/Ta_xO_y$ barrier layer. The series of samples that was not coated with the catalyst layer was subjected to X-Ray Diffraction (XRD), obtaining the spectra collected in FIG. 3, wherein peak 11 can be attributed to the titanium substrate, peaks 22 and 23 are characteristics of titanium oxide species and peaks 33, 34 and 35 can be attributed to tantalum.

By integration of the characteristic XRD peaks, the $Ti_xO_y/Ta_xO_y$ average particle diameter for each composition was obtained, as in the previous examples. The data extracted from the XRD spectra are reported in Table 3.

TABLE 3

| Composition ID | $Ti_xO_y/Ta_xO_y$ average particle diameter (nm) | $Ti_xO_y/Ta_xO_y$ particle volume (nm$^3$) | $Ti_xO_y/Ta_xO_y$ particle surface (nm$^2$) | $Ti_xO_y/Ta_xO_y$ particle surface density (particles/10,000 nm$^2$) |
|---|---|---|---|---|
| 1 | 25.20 | 8379 | 1995 | 20.05 |
| 2 | 25.00 | 8182 | 1964 | 20.36 |
| 3 | 25.12 | 8300 | 1982 | 20.18 |
| 4 | 24.65 | 7842 | 1909 | 20.95 |
| 5 | 24.90 | 8083 | 1948 | 20.53 |
| 6 | 25.58 | 8769 | 2056 | 19.45 |
| 7 | 25.57 | 8759 | 2055 | 19.46 |

An accelerated duration test was carried out on the coated samples that were not used for SEM and XRD characterisations, as in the previous examples. All samples under test showed a lifetime in the range of 700 to 800 hours, corresponding to slightly more than 100 hours per g/m$^2$ of noble metal.

EXAMPLE 3

A titanium grade 1, 0.89 mm thick expanded sheet was etched in 18% vol. HCl and degreased with acetone. The sheet was cut to 5.5 cm×15.25 cm pieces. Each piece was used as an electrode substrate and coated with a precursor solution obtained by mixing a Ti-isopropoxide solution (175 g/l in 2-propanol) and a $TaCl_5$ solution (56 g/l in concentrated HCl) in a molar ratio of 70% Ti and 30% Ta, added with selected amounts of $NbCl_5$. Five different compositions were prepared with overall Nb molar contents of 2, 4, 6, 8 and 10%.

Three different samples were prepared for each composition, in the following way: the five precursor solutions were applied to the corresponding substrate samples by brushing, then the substrates were dried at 130° C. for about 5 minutes and subsequently cured at 515° C. for 5 minutes. This operation was repeated 5 times, then each coated substrate was subjected to a final thermal treatment at 515° C. for 3 hours.

Two samples for each composition were finally coated with a catalytic layer consisting of a mixture of iridium and tantalum oxides, with a total iridium loading of 7 g/m$^2$, by thermal decomposition of an alcoholic solution of iridium and tantalum chlorides in multiple coats.

The SEM and XRD characterisations of Example 1 were repeated with similar results; in particular, the SEM analysis showed that a dual barrier layer was obtained as in Examples 1 and 2, comprised of a primary barrier layer consisting of a thermally-densified mixed titanium-tantalum-niobium oxide and a secondary barrier layer consisting of a non-stoichiometric titanium oxide grown from the substrate and modified by Ti oxide, Ta oxide and Nb oxide inclusions coming from the primary barrier layer. The particle surface density was in excess of 100 particles per 10,000 nm$^2$.

An accelerated duration test was carried out on the coated samples that were not used for SEM and XRD characterisations, as in Examples 1 and 2. All samples showed a lifetime at least slightly higher than the analogous sample without Nb addition, with a peak of 2450 hours for the sample with 4% molar content of niobium.

EXAMPLE 4

A titanium grade 1, 0.89 mm thick expanded sheet was etched in 18% vol. HCl and degreased with acetone. The sheet was cut to 5.5 cm×15.25 cm pieces. Each piece was used as an electrode substrate and coated with a precursor solution obtained by mixing a Ti-isopropoxide solution (175 g/l in 2-propanol) and a $TaCl_5$ solution (56 g/l in concentrated HCl) in a molar ratio of 70% Ti and 30% Ta, added with selected amounts of $CeCl_3$. Five different compositions were prepared with overall Ce molar contents of 2, 4, 6, 8 and 10%.

Three different samples were prepared for each composition, in the following way: the five precursor solutions were applied to the corresponding substrate samples by brushing, then the substrates were dried at 130° C. for about 5 minutes and subsequently cured at 515° C. for 5 minutes. This operation was repeated 5 times, then each coated substrate was subjected to a final thermal treatment at 515° C. for 3 hours.

Two samples for each composition were finally coated with a catalytic layer consisting of a mixture of iridium and tantalum oxides, with a total iridium loading of 7 g/m$^2$, by thermal decomposition of an alcoholic solution of iridium and tantalum chlorides in multiple coats.

The SEM and XRD characterisations of Example 1 were repeated with similar results; in particular, the SEM analysis showed that a dual barrier layer was obtained as in Examples 1 and 2, comprised of a primary barrier layer consisting of a thermally-densified mixed titanium-tantalum-cerium oxide and a secondary barrier layer consisting of a non-stoichiometric titanium oxide grown from the substrate and modified by Ti oxide, Ta oxide and Ce oxide inclusions coming from the primary barrier layer. The particle surface density was in excess of 100 particles per 10,000 nm$^2$.

An accelerated duration test was carried out on the coated samples that were not used for SEM and XRD characterisations, as in Examples 1 and 2. All samples showed a lifetime at least slightly higher than the analogous sample without Ce addition, with a peak of 2280 hours for the sample with 4% molar content of cerium.

Examples 3 and 4 showed the beneficial doping effect of niobium and cerium on the mixed oxide phase containing titanium oxide and tantalum oxide. To a lower extent, similar results could be obtained by doping the mixed oxide phase with a 2-10% molar content of tungsten or strontium.

The above description shall not be intended as a limitation of the invention, which may be practised according to different embodiments without departing from the scopes thereof, and whose extent is solely defined by the appended claims.

Throughout the description and claims of the present application, the term "comprise" and variations thereof such as "comprising" and "comprises" are not intended to exclude the presence of other elements or additives.

The discussion of documents, acts, materials, devices, articles and the like is included in this specification solely for the purpose of providing a context for the present invention. It is not suggested or represented that any or all of these matters formed part of the prior art base or were common general knowledge in the field relevant to the present invention before the priority date of each claim of this application.

What we claim is:

1. An electrode for electrolytic applications comprising:

a substrate comprising titanium or titanium alloy;

a dual barrier layer comprising a primary and a secondary barrier layer, the secondary barrier layer being in direct contact with the substrate and comprising a non-stoichiometric titanium oxide modified with tantalum oxide and titanium oxide inclusions, the primary barrier layer being in direct contact with the secondary barrier layer and comprising a thermally-densified mixed oxide phase containing titanium oxide and tantalum oxide, the primary barrier layer having a density exceeding 25 particles per 10,000 $nm^2$ surface; and a catalytic layer comprising platinum group metals or oxides thereof.

2. The electrode according to claim 1, the primary barrier layer having a density of 80 to 120 particles per 10,000 $nm^2$ surface.

3. The electrode according to claim 1, the Ti:Ta molar ratio in the mixed oxide phase comprising from about 60:40 to about 80:20.

4. The electrode according to claim 3, wherein the mixed oxide phase in the primary barrier layer further contains from about 20 to about 10 mole % of a doping agent comprising one or more of the oxides of Ce, Nb, W and Sr, the secondary barrier layer further containing inclusions of an oxide of Ce, Nb, W or Sr.

5. The electrode according to claim 1, wherein the primary barrier layer has a thickness of 3 to 25 micrometers and the secondary barrier layer having a thickness of 0.5 to 5 micrometers.

6. The electrode according to claim 1, the catalytic layer comprising iridium oxide and tantalum oxide.

7. An electrolytic process comprising the anodic evolution of oxygen on the surface of the electrode according to claim 1.

8. An electrometallurgical process comprising the anodic evolution of oxygen on the surface of the electrode according to claim 1, selected from the group consisting of electrowinning, electrorefining and electroplating.

9. A method for manufacturing an electrode, comprising:

providing a titanium or titanium alloy substrate;

coating the substrate with a mixed oxide layer in one or more coats by applying a precursor solution containing titanium and tantalum species, and optionally Ce, Nb, W or Sr species to the substrate to form a dual barrier layer comprising a primary and a secondary barrier layer, drying at 120 to 150° C. and thermally decomposing the precursor solution at 400 to 600° C. for 5 to 20 minutes after each coat;

subjecting the coated substrate to a thermal treatment in a temperature range of 400 to 600° C. for a time of 1 to 6 hours until forming the dual barrier layer; and forming a catalytic layer onto the dual barrier layer by applying and thermally decomposing a solution containing platinum group metal compounds in one or more coats.

10. The method according to claim 9, the precursor solution comprising a hydroalcoholic solution having a molar content of water of 1 to 10% and containing a Ti alkoxide species, and optionally Ti isopropoxide.

11. The method according to claim 9, the thermal decomposition step of the precursor solution containing titanium and tantalum species followed by a quenching step.

12. The method according to claim 11, the cooling rate of the quenching step is at least 200° C./s.

* * * * *